US008120283B2

(12) United States Patent
Tanaka et al.

(10) Patent No.: US 8,120,283 B2
(45) Date of Patent: Feb. 21, 2012

(54) LED DEVICE AND LED DRIVER

(75) Inventors: Shinichi Tanaka, Tokyo (JP); Kiyoshi Narisawa, Hyogo-Ken (JP)

(73) Assignee: Texas Instruments Incorporated, Dallas, TX (US)

( * ) Notice: Subject to any disclaimer, the term of this patent is extended or adjusted under 35 U.S.C. 154(b) by 358 days.

(21) Appl. No.: 12/469,206

(22) Filed: May 20, 2009

(65) Prior Publication Data

US 2009/0289559 A1 Nov. 26, 2009

(30) Foreign Application Priority Data

May 20, 2008 (JP) ..... 2008-131784

(51) Int. Cl.
*H05B 37/02* (2006.01)

(52) U.S. Cl. ..... 315/307; 315/193; 315/291; 315/294; 315/308

(58) Field of Classification Search ..... 315/185 R, 315/193, 209 R, 291, 294, 307, 308
See application file for complete search history.

(56) References Cited

U.S. PATENT DOCUMENTS

| | | | | |
|---|---|---|---|---|
| 6,975,023 | B2 * | 12/2005 | Oliver et al. | 257/676 |
| 7,205,727 | B2 * | 4/2007 | Takeshita et al. | 315/291 |
| 7,550,934 | B1 * | 6/2009 | Deng et al. | 315/308 |
| 2006/0186830 | A1 * | 8/2006 | Shami et al. | 315/291 |
| 2008/0304305 | A1 * | 12/2008 | Chang et al. | 363/147 |
| 2009/0273290 | A1 * | 11/2009 | Ziegenfuss | 315/193 |

* cited by examiner

*Primary Examiner* — Douglas W Owens
*Assistant Examiner* — Thai Pham
(74) *Attorney, Agent, or Firm* — William B. Kempler; Wade J. Brady, III; Frederick J. Telecky, Jr.

(57) ABSTRACT

A LED device having a LED array, LED driver ICs, DC-DC converter, a first feedback circuit consisting of voltage dividing resistors, and a headroom voltage monitoring circuit having controller and second feedback circuit. In second feedback circuit, headroom voltages obtained at output current terminals of the LED driver ICs, are fed back to DC-DC converter.

18 Claims, 8 Drawing Sheets

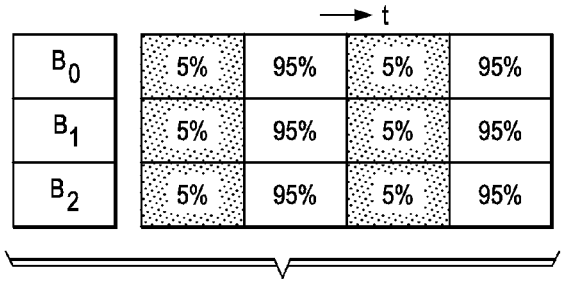
FIG. 8
FIG. 9
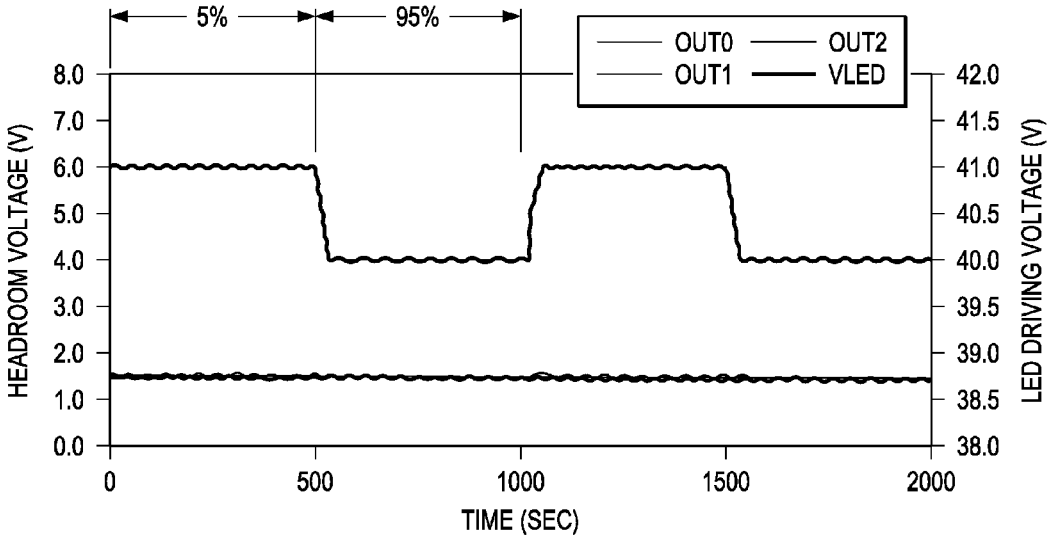
FIG. 10
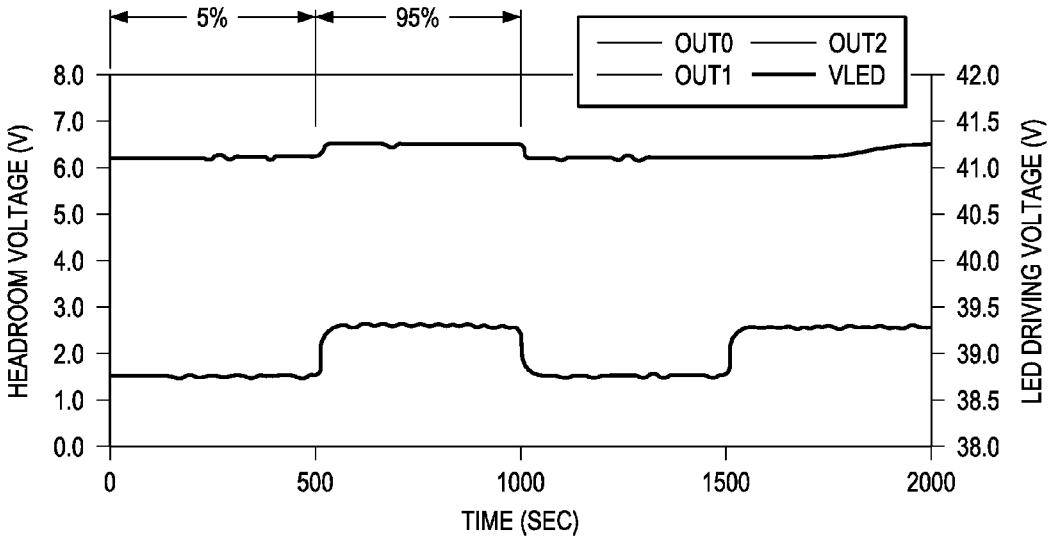

LED DEVICE AND LED DRIVER

FIELD OF THE INVENTION

The present invention pertains to an LED device that can be used in backlighting, illumination, displays, etc., and an LED driver for driving said LED to emit light.

BACKGROUND OF THE INVENTION

At present, LEDs (light-emitting diodes) of various types, such as those with high luminance of light emission, and those emitting white light and various colors of light have been developed and are in mass production, and have found wide application in various fields, such as backlighting, illumination, displays, etc.

FIG. 11 is a diagram illustrating the circuit constitution of a conventional LCD device in the prior art for use as a backlight in LCD (liquid crystal display)-TV (television) applications. As shown in the figure, this LCD device has LED array 12 consisting of n×m LEDs ($\mathbf{10}_{(0,0)}$, . . . $\mathbf{10}_{(n-2,0)}$, $\mathbf{10}_{(N-1,0)}$)-($\mathbf{10}_{(0,m-1)}$, . . . $\mathbf{10}_{(n-2,m-1)}$, $\mathbf{10}_{(N-1,m-1)}$) (where n and m are integers of 2 or more) and one or a plurality (N) of LED driver ICs (integrated circuits) 14(0)-14(N−1) of, e.g., the 16-channel type, a DC power source, such as DC-DC converter 16, and controller 18.

As shown in FIG. 11, in each column, LEDs $\mathbf{10}_{(0,y)}$, . . . $\mathbf{10}_{(n-2,y)}$, $\mathbf{10}_{(N-1,y)}$ (y=0 to m−1) are electrically connected in series between the output terminal of DC-DC converter 16 and the corresponding current terminals $OUT_y$ of LED driver IC 14. For example, as the first column, LED $\mathbf{10}_{(0,0)}$, . . . $\mathbf{10}_{(n-2,0)}$, $\mathbf{10}_{(N-1,0)}$ are electrically connected in series between the output terminal of DC-DC converter 16 and first current terminal $OUT_0$ of first LED driver IC 14(0). On the other hand, as the mth column, LED $\mathbf{10}_{(0,m-1)}$, . . . $\mathbf{10}_{(n-2,m-1)}$, $\mathbf{10}_{(N-1,m-1)}$ are electrically connected in series between the output terminal of DC-DC converter 16 and the tail current terminal $OUT_{m-1}$ used in the Nth LED driver IC 14(N−1).

For said LED backlight, an area-light system is adopted, and, as shown in FIG. 12, backlight region 22 is divided in matrix configuration into m (m=i×j) blocks $B_0$, $B_1$, . . . $B_{m-1}$, and, in each block $B_y$, the various corresponding column LEDs $\mathbf{10}_{(0,y)}$, . . . $\mathbf{10}_{(n-2,y)}$, $\mathbf{10}_{(N-1,y)}$ shown in FIG. 11 are set two-dimensionally with a constant density distribution as shown in FIG. 13.

In FIG. 11, DC-DC converter 16 is a switching power source that works as, e.g., a chop method voltage boosting type converter. For example, it boosts DC input voltage $V_{IN}$ input as 24 V voltage to a DC voltage at a prescribed level of, e.g., 50 V, that is output as LED driving voltage $V_{LED}$.

Said DC-DC converter 16 performs constant-voltage control for its output voltage, that is, LED driving voltage $V_{LED}$. For this purpose, it has reference voltage input terminal REF, feedback voltage input terminal FB, and a feedback circuit consisting of voltage dividing resistors 24, 26. More specifically, said voltage dividing resistors 24, 26 are connected in series between the output terminal of DC-DC converter 16 and the ground potential terminal. Node $N_A$ between the two resistors is connected to feedback voltage input terminal $F_B$. Assuming that the resistances of said voltage dividing resistors 24, 26 are $R_{24}$ and $R_{26}$, voltage divided voltage $V_A$ obtained by multiplying coefficient $R_{26}/(R_{24}+R_{26})$ with LED driving voltage $V_{LED}$ is obtained at node $N_A$. Said voltage divided voltage $V_A$ is input as feedback voltage to feedback voltage input terminal $F_B$. On the other hand, a prescribed reference voltage $V_{REF}$ is input from controller 18 to reference voltage input terminal REF. Said DC-DC converter 16 performs the operation of a switching power source so that feedback voltage $V_A$ from voltage dividing circuit (24, 26) is equal to reference voltage $V_{REF}$.

Each of LED driver ICs 14(*x*) (x=0 to N−1) has a 16-channel sink type constant current driving circuit. The output terminals of the various constant current driving circuits are taken as said current terminals $OUT_y$ (y=0 to m−1). The constant current driving circuit of each channel works so that a prescribed LED driving current $I_y$ flows in LEDs $\mathbf{10}_{(0,y)}$, . . . $\mathbf{10}_{(n-2,y)}$, $\mathbf{10}_{(N-1,y)}$ of the corresponding column. Here, in order to guarantee stable constant current operation, a voltage over the prescribed level should be kept as headroom voltage $HV_y$ at each of current terminals $OUT_y$, and the output voltage of DC-DC converter 16, that is, LED driving voltage $V_{LED}$ is set so that said headroom voltage condition is met. Here, said headroom voltage $HV_y$ at each current terminal $OUT_y$ is represented by $HV_y=V_{LED}-V_{y(0\ to\ N-1)}$, where $V_{y(0\ to\ N-1)}$ represents the total voltage fall generated in the corresponding LED serial circuit ($\mathbf{10}_{(0,y)}$, . . . $\mathbf{10}_{(n-2,y)}$, $\mathbf{10}_{(N-1,y)}$).

Together with a desired clock signal from controller 18, the data and control signal for controlling the brightness of the LED backlight are input to each LED driver IC 14(*x*). For a recently developed LCD-TV unit, the local dimming scheme is adopted. According to this scheme, for the image on each frame, the brightness of the LED backlight is under variable control in units of area or blocks. In order to perform said local dimming, grey scale data indicating the luminance or brightness degree of each block $B_y$ are sent in serial transfer to the constant current driving circuit from controller 18 at a constant cycle (e.g. 120 Hz), and each constant current driving circuit works based on each grey scale datum to variably control the ON time of LED driving current $I_y$ in each cycle, that is, the duty, with a PWM (pulse width modulation) control system.

As shown in FIG. 11, NMOS transistor 28 is set for protecting each constant current driving circuit from high voltage in case of an LED short circuit since it is connected between LEDs $\mathbf{10}_{(0,y)}$, . . . $\mathbf{10}_{(n-2,y)}$, $\mathbf{10}_{(N-1,y)}$ and the corresponding current terminals $OUT_y$. Said NMOS transistor 28 is biased to bias voltage $V_k$ provided by the voltage dividing circuit consisting of resistors 30, 32, and the voltage of each current terminal $OUT_y$ is restricted to a prescribed level of ($V_k+V_{th}$) or lower. Here, $V_{th}$ represents the threshold voltage of NMOS transistor 28.

Usually, the forward voltage of an LED has negative temperature characteristics. The lower the temperature of the LED, the larger the voltage decrease generated in the LED in the light emission state, and the lower the headroom voltage $HV_y$ obtained at each current terminal $OUT_y$ in LED driver IC 14(*x*). Consequently, output voltage $V_{LED}$ of DC-DC converter 16 is set so that headroom voltage $HV_y$ over a prescribed level is guaranteed at each current terminal $OUT_y$ even at a temperature lower than the lowest operating temperature of the LCD-TV.

On the other hand, when the temperature of an LED rises due to a rise in the ambient temperature or due to self-heating of the LED, the voltage decrease at the LED in the light emission state decreases, and, corresponding to this, headroom voltage $HV_y$ at each current terminal $OUT_y$ in LED driver IC 14(*x*) rises. This is undesired. That is, each constant current driving circuit works such that a prescribed LED driving current $I_y$ flows. Consequently, the higher the headroom voltage $HV_y$, the higher the power consumption of the constant current driving circuit. In addition, when the overall power consumption (heat generation quantity) of LED driver IC 14(*x*) is over the permissible loss of the IC package, the driver circuit is broken or malfunctions so that normal operation cannot be performed, and the reliability falls.

SUMMARY OF THE INVENTION

An objective of the present invention is to solve the aforementioned problems of the prior art by providing an LED driver and an LED device characterized by the fact that when the LED is driven to emit light, the power consumption generated in the constant current driving circuit is suppressed or reduced, while stable and normal operation of the constant current driving circuit can be guaranteed.

In order to realize the aforementioned objective, one aspect of the present invention provides an LED driver characterized by the fact that the LED driver is for driving one or plural LEDs (light emitting diodes), connected in series with each other electrically, to emit light, and it has the following parts: a DC power source that outputs a DC LED driving voltage, a constant current driving circuit connected in series with said LED with respect to said DC power source for injecting a constant LED driving current in said LED, and a headroom voltage monitoring circuit that works on said DC power source and performs dynamic variable control of the voltage level of said LED driving voltage so that the headroom voltage obtained at the current terminal of said constant current driving circuit is kept near a first reference voltage.

For an aspect of the LED driver of the present invention, said DC power source has the following parts: a DC power source that outputs a DC LED driving current, an LED array having m LED serial circuits (m is an integer of 2 or greater), each having n LEDs (n is an integer of 2 or greater) electrically connected in series, electrically connected in parallel with respect to the output terminal of said DC power source, m constant current driving circuits for injecting constant LED driving currents into said LEDs and connected in series with said m LED serial circuits with respect to said DC power source, and a headroom voltage monitoring circuit that works on said DC power source and dynamically variably controls the voltage level of said LED driving voltage so that at least one of the headroom voltages obtained at the current terminals of said m constant current driving circuits is kept near a first reference voltage.

According to an aspect the present invention, while a constant LED driving current is injected into each LED by means of the DC power source and a constant current driving circuit, the headroom voltage obtained at the current terminal of the constant current driving circuit is monitored by a headroom voltage monitoring circuit. The headroom voltage monitoring circuit works on the DC power source to dynamically variably control the output voltage, that is, the LED driving voltage so that the headroom voltage is kept near the first reference voltage. As a result, even if the voltage fall of the LED varies due to the environmental temperature or self-heating of the LED, especially if the voltage fall changes, especially to become smaller, the feedback loop works via the headroom voltage monitoring circuit, and the headroom voltage is kept stably near the first reference voltage such that the power consumption and the heat generated in the constant current driving circuit can be suppressed within a prescribed limit.

In an embodiment of the present invention, the DC power source has a switching power source part, which has a first switching element that can be turned ON/OFF at high frequency, and which turns said first switching element ON/OFF and converts said input voltage to said LED driving voltage, a switching control part, which controls the ON/OFF operation of said first switching element in said switching power source part, and a first feedback circuit that feeds back said LED driving voltage to said switching control part; said headroom voltage monitoring circuit has a second feedback circuit that feeds back said headroom voltage to said switching control part of said DC power source.

In this case, the following scheme is utilized: said switching control part has a reference voltage input terminal and a feedback voltage input terminal, and it controls the ON/OFF operation of said first switching element so that the voltage input to said feedback voltage input terminal is equal to a second reference voltage input to said reference voltage input terminal. Said first feedback circuit has a first resistor and a second resistor connected between the output terminal of said switching power source part and the terminal of the reference potential; the node between said first resistor and said second resistor is connected to said feedback voltage input terminal of said switching control part. The second feedback circuit has the following parts: a first transistor connected between said feedback voltage input terminal of said switching control part and said reference potential terminal, a comparator that compares said headroom voltage to said first reference voltage, and outputs a comparison result signal indicating the magnitude relationship between said two voltages, and a feedback controller that controls said first transistor corresponding to said comparison result signal output from said comparator. More specifically, in the second feedback circuit, a third resistor is connected in series with the first transistor between said feedback voltage input terminal of said switching control part and said reference potential terminal.

In an embodiment, the feedback controller has a latch circuit that latches said comparison result signal output from said comparator every prescribed cycle at a prescribed timing, and a second transistor that works as follows: said comparison result signal latched with said latch circuit is input as a control signal; when said comparison result signal indicates that said headroom voltage is higher than said first reference voltage, it is turned ON, so that said first transistor is turned ON or the current flowing in said first transistor is increased; and, when said comparison result signal indicates that said headroom voltage is lower than said first reference voltage, it is turned OFF, so that said first transistor is turned OFF or the current flowing in said first transistor is decreased.

In an embodiment, said feedback controller has a time constant circuit connected between the output terminal of said second transistor and the control terminal of said first transistor. In addition, it has a bias circuit that provides a prescribed bias voltage to the control terminal of said first transistor.

In an embodiment, said constant current driving circuit has a constant current source for maintaining said LED driving current constant, a second switching element that is connected in series with said constant current source and can be turned ON/OFF at a high frequency, and an LED luminance controller that turns said second switching element ON/OFF at a constant period in a pulse width modulation system.

In an embodiment of the LED device of the present invention, the LED device of the present invention has one face light source consisting of m blocks; m said LED serial circuits and m said constant current driving circuits are respectively allotted to said m blocks; in each said block, n said LEDs that form said LED serial circuit are arranged two-dimensionally with a constant density distribution. In this case, in each block, the duty is individually controlled with said pulse width modulation system.

BRIEF DESCRIPTION OF THE DRAWINGS

FIG. 8 is a diagram illustrating the pattern of duty control adopted in an experiment to check the effect of the LED device (FIG. 5) in the embodiment with a local dimming function.

FIG. 9 is a waveform diagram illustrating the waveforms of the headroom voltage and the LED driving voltage obtained in said experiment.

FIG. 10 is a diagram illustrating the waveforms of the headroom voltage and LED driving voltage obtained in an experiment the same as the aforementioned experiment, except for omission of the second feedback circuit from the LED device in the embodiment (FIG. 5), as a comparative example.

REFERENCE NUMERALS AND SYMBOLS AS SHOWN IN THE DRAWINGS

In the FIG. 10 represents an LED, 12 represents an LED array, 14(0)-14(N−1) represent LED driver ICs, 16 represents a DC-DC converter, 24, 26 represent voltage dividing resistors (first feedback circuit), 38 represents a controller, 48 represents a switching power source part, 50 represents a switching controller, FB represents a feedback voltage input terminal, REF represents a reference voltage input terminal, 60(0)-60(15) represent constant current driving circuits, 62(0)-62(15) represent switching elements, 64(0)-64(15) represent constant current sources, 66(0)-66(15) represent grey scale PWM controllers, 80 represents a second feedback circuit, 82 represents a resistor, 84 represents an NMOS transistor, 86(0)-86(m−1) represent converters, 88 represents a feedback controller, 90 represents a logic circuit, 92 represents a latch circuit, 94 represents a PMOS transistor, 95 represents a reference voltage generator, 96 represents a time constant circuit, and 98(0)-98(m−1) represent diodes.

DESCRIPTION OF THE EMBODIMENTS

According to an aspect of the LED device and LED driver of the present invention with said constitution and operation, while the power consumption generated in the constant current driving circuit in light emission driving of LEDs is suppressed or reduced, stable or normal operation of the constant current driving circuit can be guaranteed.

In the following, an explanation will be given regarding an embodiment of the present invention with reference to FIGS. 1-10.

Figure 1:
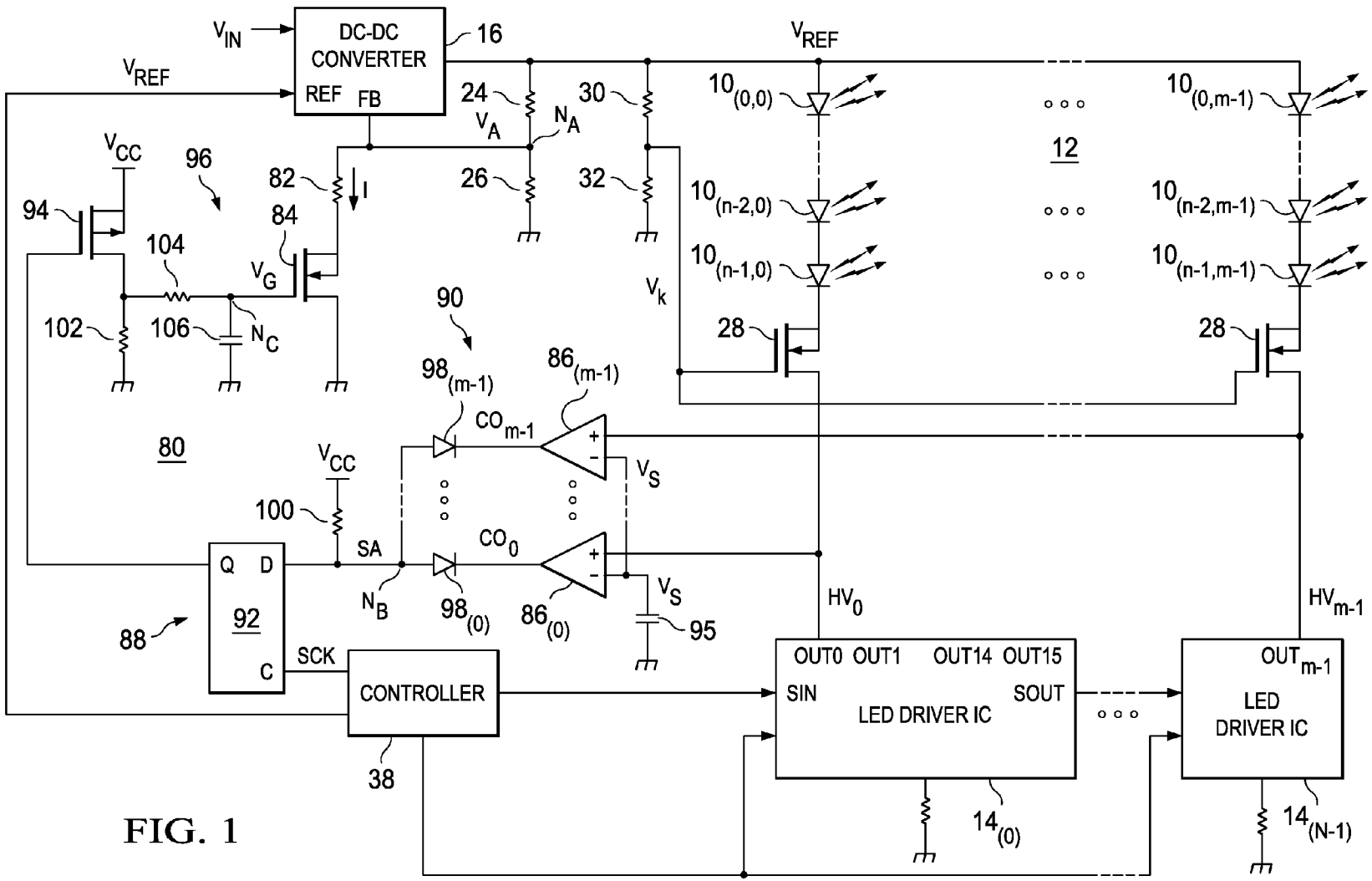
FIG. 1 is a circuit diagram illustrating the constitution of a circuit of an LED device having an LED driver in an embodiment of the present invention.
Figure 11:
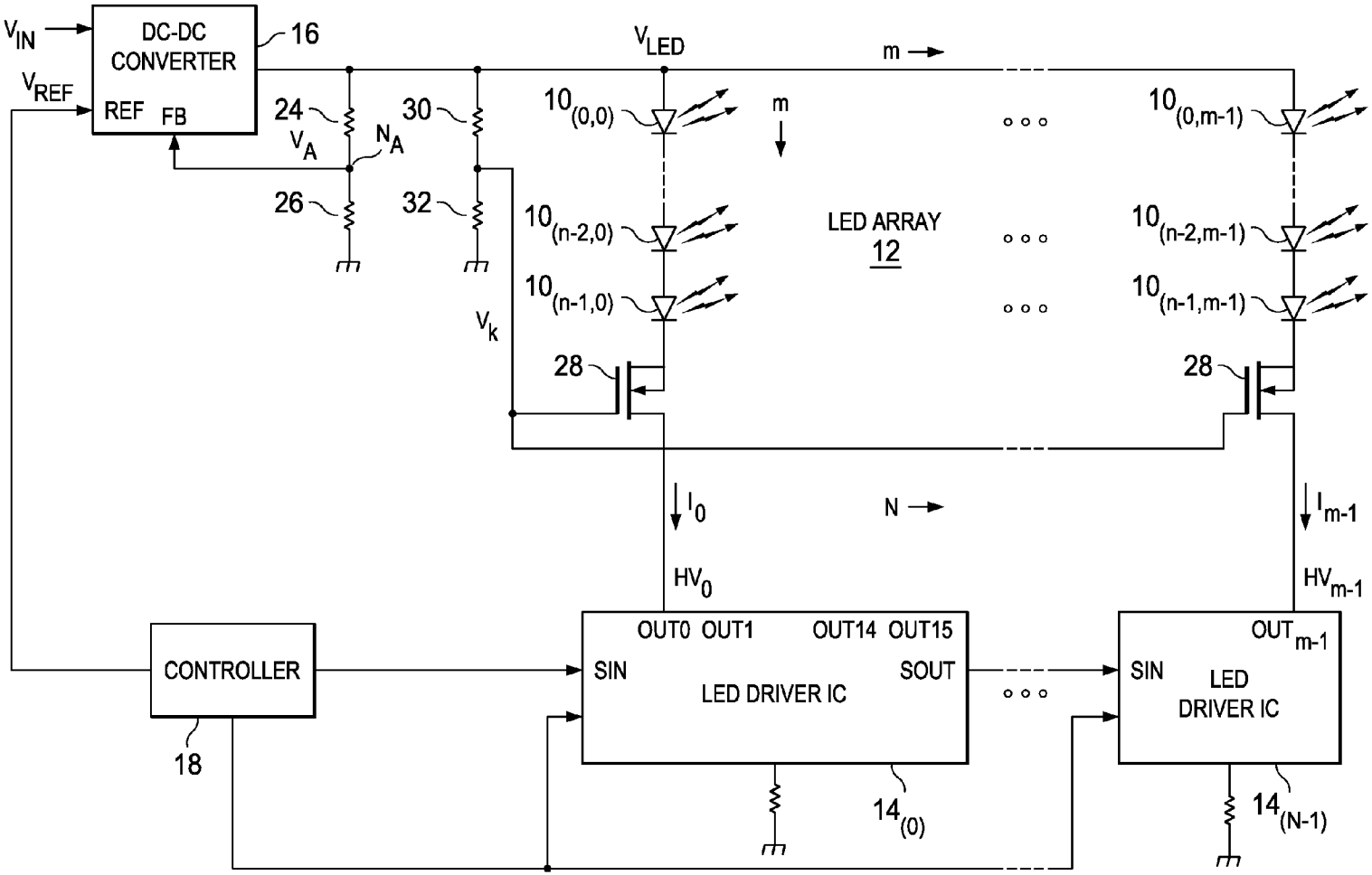
FIG. 11 (PRIOR ART)
FIG. 11 is a circuit diagram illustrating the circuit constitution of an LCD device in the prior art for use in a backlight for an LCD-TV unit.

FIG. 1 is a diagram illustrating the circuit constitution of an LED device having an LED driver in an embodiment of the present invention. This LED device, for example, can be used in the LED backlight for an LCD-TV unit. In this figure, the same symbols as those used above in the prior art shown in FIG. 11 are adopted. errata The principal constitution of this LED device is similar to that of the LED device in the prior art (FIG. 11). It has LED array 12 consisting of n×m LEDs ($\mathbf{10}_{(0,0)}$, . . . $\mathbf{10}_{(n-2,0)}$, $\mathbf{10}_{(N-1,0)}$)-($\mathbf{10}_{(0,m-1)}$, . . . $\mathbf{10}_{(n-2,m-1)}$, $\mathbf{10}_{(N-1,m-1)}$) (where n and m are integers of 2 or more), one or plural (N) LED driver ICs 14(0)-14(N−1) of, e.g., a 16-channel type, a DC power source, such as DC-DC converter 16, voltage dividing resistors 24, 26 for feedback, transistor 28 for high voltage protection, and bias circuit (30, 32). In this embodiment, the feedback circuit consisting of voltage dividing resistors 24, 26 forms a first feedback circuit.

Figure 12:
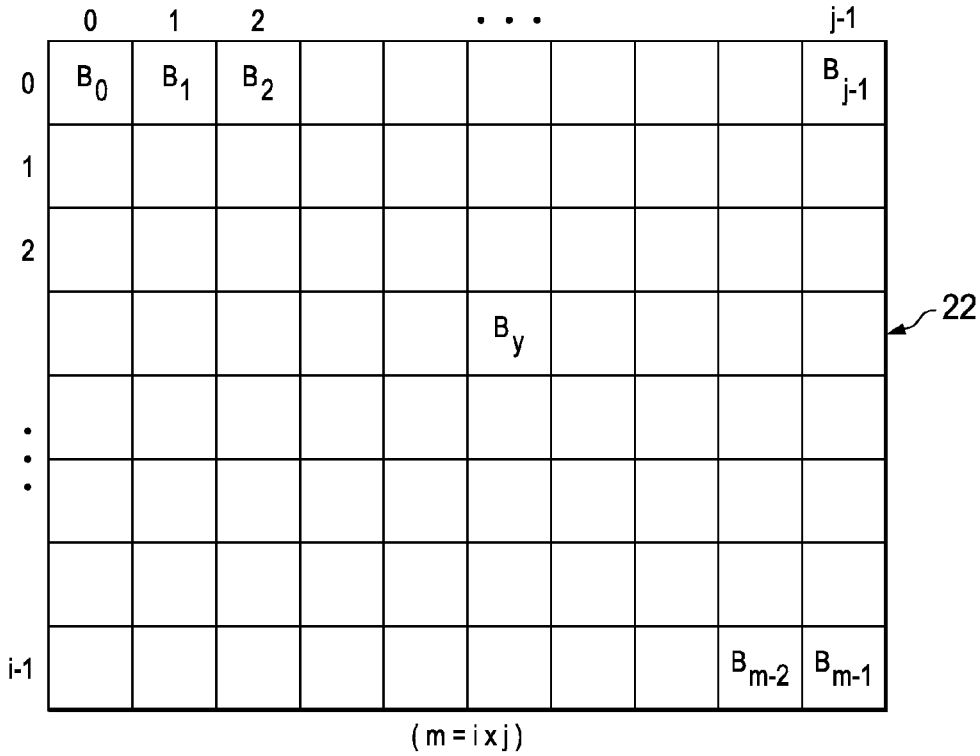
FIG. 12 (PRIOR ART)
FIG. 12 is a diagram illustrating a constitution in which an LED backlight is divided into plural blocks in a matrix configuration.
Figure 13:
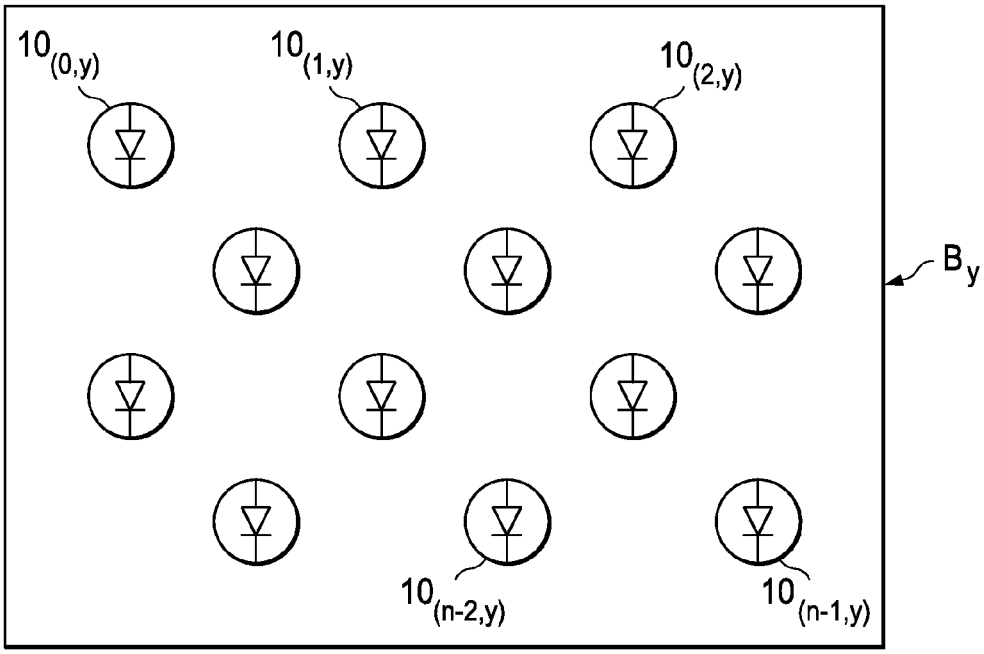
FIG. 13 (PRIOR ART)
FIG. 13 is a diagram illustrating an example of the configuration of LEDs in each block of an LED backlight unit.

Just as in the LED device of the prior art (FIG. 11), for LED array 12, in each column, LEDs $\mathbf{10}_{(0,y)}$, . . . $\mathbf{10}_{(n-2,y)}$, $\mathbf{10}_{(N-1,y)}$ (y=0 to m−1) are electrically connected in series between the output terminal of DC-DC converter 16 and the corresponding current terminals $OUT_y$ of any of LED driver ICs 14(*x*) (x=0 to N−1). Here, for said LED backlight, an area-light system is adopted. As shown in FIG. 12, backlight region 22 is divided in a matrix configuration into m blocks $B_0$, $B_1$, . . . $B_{m-1}$ (m=i×j). In each block $B_y$, said LEDs $\mathbf{10}_{(0,y)}$, . . . $\mathbf{10}_{(n-2,y)}$, $\mathbf{10}_{(N-1,y)}$ of the corresponding columns shown in FIG. 1 are arranged two-dimensionally with a constant density distribution as shown in FIG. 13.

Figure 2:
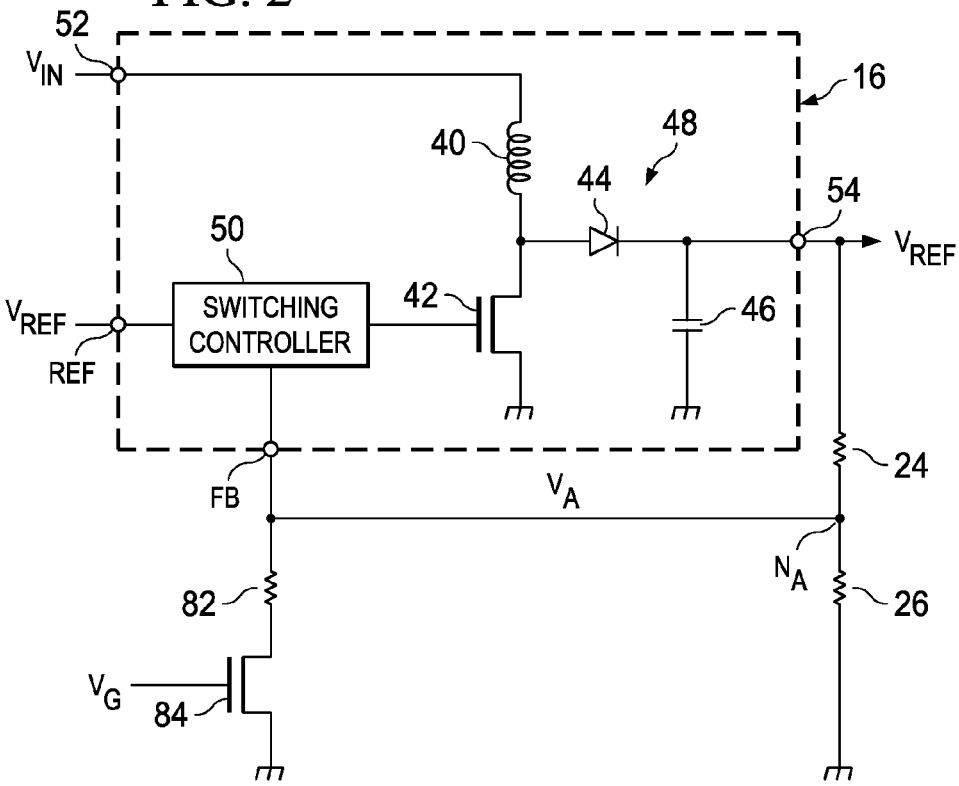
FIG. 2 is a circuit diagram illustrating an example of the constitution of the DC-DC converter used in the LED device in the embodiment.

FIG. 2 is a diagram illustrating an example of the constitution of DC-DC converter 16. This DC-DC converter 16 has switching power source part 48 consisting of inductance coil 40, NMOS transistor (switching element) 42, diode 44, and capacitor 46, and switching controller 50 that controls the ON/OFF operation of NMOS transistor 42 with a pulse control system, such as a PWM control system. For PWM control, clock signal CK at a prescribed frequency, e.g., 150 kHz, is fed from controller 38 or a clock circuit (not shown in the figure) to switching controller 50.

In the PWM control performed with switching controller 50, during the period when NMOS transistor 42 is ON in each cycle, a current flows via inductance coil 40 and NMOS transistor 42 from voltage input terminal 52 where input voltage $V_{IN}$ is input to the terminal at the ground potential, and energy is stored in inductance coil 40. Then, when NMOS transistor 42 is turned OFF in each cycle, the energy stored in inductance coil 40 is released via diode 44 to a side of capacitor 46, such that capacitor 46 is charged to a voltage higher than input voltage $V_{IN}$, and the inter-terminal voltage of capacitor 46 is output as LED driving voltage $V_{LED}$ from output terminal 54.

Figure 3:
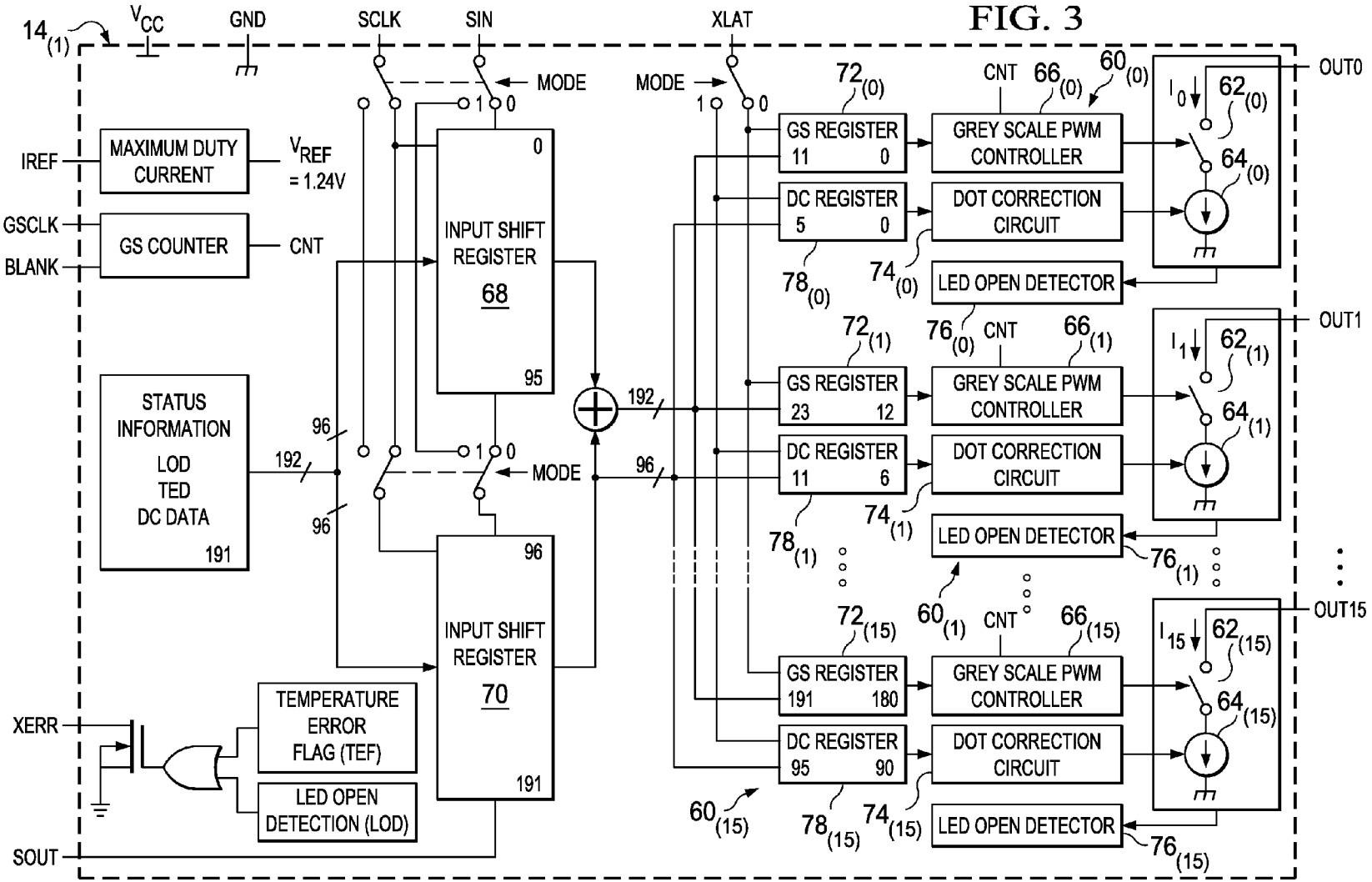
FIG. 3 is a block diagram illustrating an example of the constitution of the interior of the LED driver IC used in the LED device in the embodiment.

FIG. 3 is a diagram illustrating an example of the constitution of the circuit inside LED driver IC 14(0). Other LED driver ICs 14(1)-14(N−1) have the same constitution.

As shown in FIG. 3, in LED driver IC 14(0), 16 channel constant current driving circuits 60(0)-60(15) are arranged. The principal structural elements in each of constant current driving circuits 60(*y*) (y=0-15) include switching elements 62(*y*) and constant current sources 64(*y*) connected in series between LEDs $\mathbf{10}_{(0,y)}$, . . . $\mathbf{10}_{(n-2,y)}$, $\mathbf{10}_{(N-1,y)}$ of the corresponding column (FIG. 1) and the ground potential terminal, and grey scale PWM controllers 66($y$) that use the PWM control system to control the ON/OFF operation of switching elements 62($y$) based on grey scale data $GS_y$ that indicate in a stepwise manner the degree of luminance or brightness of corresponding block $B_y$.

For local timing, said grey scale data $GS_y$ sent in serial transfer every prescribed cycle (such as 120 Hz) from controller 38 (FIG. 1) is loaded via input shift registers 68, 70 to each GS register 72($y$). Each grey scale PWM controller 66($y$) works based on grey scale data $GS_y$ loaded in each GS register 72($y$), and variably controls using the PWM control system for the ON time of each switching element 62($y$) in each cycle, that is, the time in which LED driving current $I_y$ flows (pulse width). When grey scale data $GS_y$ is, e.g., 12 bits, the pulse width can be controlled in 4096 ($2^{12}$) steps for LED driving current $I_y$ of each channel. As a result, luminance can be controlled with 4096 steps for each block $B_y$.

In LED driver IC 14(0), as an annexed function, dot correction circuits 74(0)-74(15) are set to individually control said constant current sources 64(0)-64(15) so that dispersion in LED driving currents $I_0$-$I_{15}$ between channels can be eliminated. Dot correction data $DC_y$ for each channel sent by means of serial transfer from controller 38 in the initialization (FIG. 1) are loaded via input shift registers 68, 70 in DC registers 78($y$). Each dot correction circuit 74($y$) corrects LED driving current $I_y$, that is, the current flowing in each constant current source 64($y$), based on dot correction data $DC_y$ loaded in each DC register 78($y$). For example, when the dot correction data have 6 bits, 64-step fine adjustment is possible for LED driving current $I_y$ of each channel. In addition, if an open circuit develops due to damage of an LED in constant current driving circuits 60(0)-60(15), in order to detect such state, LED open detectors 76(0)-76(15) or the like are set in LED driver IC 14(0).

Again with reference to FIG. 1, the LED device in this embodiment most differs from the LED device (FIG. 11) in the prior art with respect to the following feature: m headroom voltages HV(0)-HV(m−1) obtained at m current terminals $OUT_0$-$OUT_{m-1}$ connected to LED array 12 are fed back via feedback circuit 80 to DC-DC converter 16. Said controller 38 of the LED device controls in a prescribed way not only LED driver ICs 14(0)-14(N−1) and DC-DC converter 16, but also second feedback circuit 80. In this embodiment, said controller 38 and feedback circuit 80 form the headroom voltage monitoring circuit in the present invention.

Said second feedback circuit 80 has the following parts: resistor 82 and NMOS transistor 84 connected in series between feedback voltage input terminal FB of DC-DC converter 16 and the ground potential terminal, m comparators 86(0)-86(m−1) for comparing the m headroom voltages HV(0)-HV(m−1) obtained at m current terminals $OUT_0$-$OUT_{m-1}$, respectively, to prescribed reference voltage $V_S$, and feedback controller 88 that controls NMOS transistor 84 corresponding to m comparison result signals $CO_0$-$CO_{m-1}$ output from said comparators 86(0)-86(m−1), respectively.

For said comparators 86($y$) (y=0 to m−1), while headroom voltage $HV_y$ of each current terminal $OUT_y$ is input to one input terminal (+), prescribed reference voltage $V_S$ is input from reference voltage generator 95 to the other input terminal (−). When headroom voltage $HV_y$ is higher than reference voltage $V_S$, H-level comparison result signal $CO_y$ is output, and, when headroom voltage $HV_y$ is lower than reference voltage $V_S$, L-level comparison result signal $CO_y$ is output.

Said feedback controller 88 has the following circuits: logic circuit 90 connected to the output terminals of said m comparators 86(0)-86(m−1), latch circuit 92 made of a D-type flip-flop circuit connected to the output terminal of logic circuit 90, PMOS transistor 94 connected to the output terminal of said latch circuit 92, and time constant circuit 96 connected between the output terminal of said PMOS transistor 94 and the gate terminal of NMOS transistor 84.

Said logic circuit 90 consists of m diodes 98(0)-98(m−1), the cathode terminals of which are connected to the output terminals of comparators 86(0)-86(m−1), respectively, and the anode terminals of which are commonly connected to data input terminal (D) of latch circuit 92, and pull-up resistor 100 connected between the anode terminals of said diodes 98(0)-98(m−1) or node $N_B$ and the terminal of power source voltage $V_{cc}$. When all comparison result signals $CO_0$-$CO_{m-1}$ output from comparators 86(0)-86(m−1) are H-level, H-level judgment signal SA is obtained at node $N_B$, and, when at least one of comparison result signals $CO_0$-$CO_{m-1}$ is L-level, L-level judgment signal SA is obtained at node $N_B$. In this way, in this embodiment, logic circuit 90 works as an AND circuit.

From controller 38, sampling clock SCK is fed to clock terminal (C) of latch circuit 92 every prescribed cycle (that is, every prescribed cycle of PWM control of LED driving current $I_{LED}$ in each LED driver IC 14($x$)) and at a prescribed timing (that is, immediately after starting the continuing time of running of the current of LED driving current $I_{LED}$). Corresponding to said sampling clock SCK, latch circuit 92 latches judgment signal SA, and sends output (Q) on the same logic level as that of the latched judgment signal SA to the gate terminal of PMOS transistor 94.

The source terminal of said PMOS transistor 94 is connected to the terminal of power source voltage $V_{cc}$, and its drain terminal (output terminal) is connected via resistor 102 to the terminal of the ground potential while it is connected to the gate terminal of NMOS transistor 84 via time constant circuit 96. Said time constant circuit 96 is composed of resistor 104 and capacitor 106.

When output signal (Q) of latch circuit 92 is H-level, that is, when all of headroom voltages $HV_0$-$HV_{15}$ of all the channels at the timing of sampling clock SCK immediately preceding it are higher than reference voltage $V_S$, PMOS transistor 94 enters the OFF state. When PMOS transistor 94 goes OFF, capacitor 106 of time constant circuit 96 discharges via resistors 104, 102, and the potential at node $N_C$, that is, gate voltage $V_G$ of NMOS transistor 84, falls. As a result, bias current (i) flowing from node $N_A$ of voltage dividing resistors 24, 26 that form the first feedback circuit via resistor 82 and NMOS transistor 84 decreases, or bias current (i) is turned OFF, while feedback voltage $V_{FB}$ input to feedback voltage input terminal $F_B$ of DC-DC converter 16 rises.

When output signal (Q) of latch circuit 92 is L-level, that is, when at least one of headroom voltages $HV_0$-$HV_{15}$ at the timing of sampling clock SCK immediately preceding it is lower than reference voltage $V_S$, PMOS transistor 94 goes ON. When PMOS transistor 94 is on, capacitor 106 of time constant circuit 96 is charged via PMOS transistor 94 and resistor 104, and the potential of node $N_C$, that is, gate voltage $V_G$ of NMOS transistor 84, rises. As a result, bias current (i) flowing from node $N_A$ of voltage dividing resistors 24, 26 via resistor 82 and NMOS transistor 84 rises, and feedback voltage $V_{FB}$ falls.

In this way, in this embodiment, said second feedback circuit 80 works as follows: when all headroom voltages $HV_0$-$HV_{15}$ of all the channels at the timing of sampling clock SCK given at a prescribed period from controller 38 are higher than reference voltage $V_S$, feedback voltage $V_{FB}$ rises with respect to DC-DC converter 16, and, when at least one of headroom voltages $HV_0$-$HV_{15}$ is lower than reference voltage $V_S$, feedback voltage $V_{FB}$ falls.

In DC-DC converter 16, when feedback voltage $V_{FB}$ is lower than reference voltage $V_{REF}$, the duty of the ON/OFF operation of switching element 42 is raised by switching controller 50 (FIG. 2) so that the error between said feedback voltage and reference voltage becomes zero, that is, the voltage level of output voltage $V_{LED}$ rises. Conversely, when feedback voltage $V_{FB}$ is higher than reference voltage $V_{REF}$, the duty of the ON/OFF operation of switching element 42 is decreased by switching controller 50 so that said error becomes zero, that is, the voltage level of output voltage $V_{LED}$ is lowered.

Also, the transmission characteristics of said second feedback circuit 80 can be adjusted as desired, and the value of the time constant of time constant circuit 96, the values of voltage dividing resistors 24, 26, 82, reference voltage $V_{REF}$, etc., may be selected appropriately.

Figure 4:
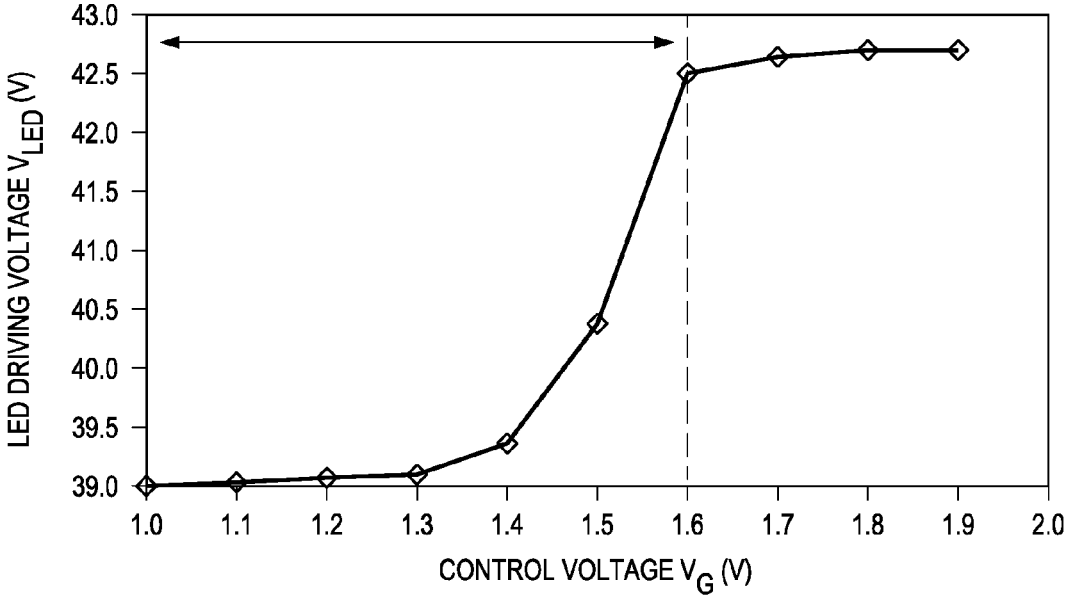
FIG. 4 is a diagram illustrating an example of the DC relationship between control voltage $V_G$ at node $N_C$ in a second feedback circuit of the LED device and the output voltage (LED driving voltage) $V_{LED}$ of the DC-DC converter in the embodiment.

FIG. 4 is a diagram illustrating an example of the DC relationship between control voltage $V_G$ obtained from node $N_C$ of time constant circuit 96 and output voltage (LED driving voltage) $V_{LED}$ of DC-DC converter 16 (VG-VLEG characteristics). In this example, gate voltage $V_G$ is set to vary within the range of 1.0-1.6 V so that variation of LED driving voltage $V_{LED}$ is restricted to the range of 39-42.5 V. The permissible variation range of LED driving voltage $V_{LED}$ depends on the constitution of the LED array, the forward voltage characteristics of the LEDs, the ambient temperature, etc.

Figure 5:
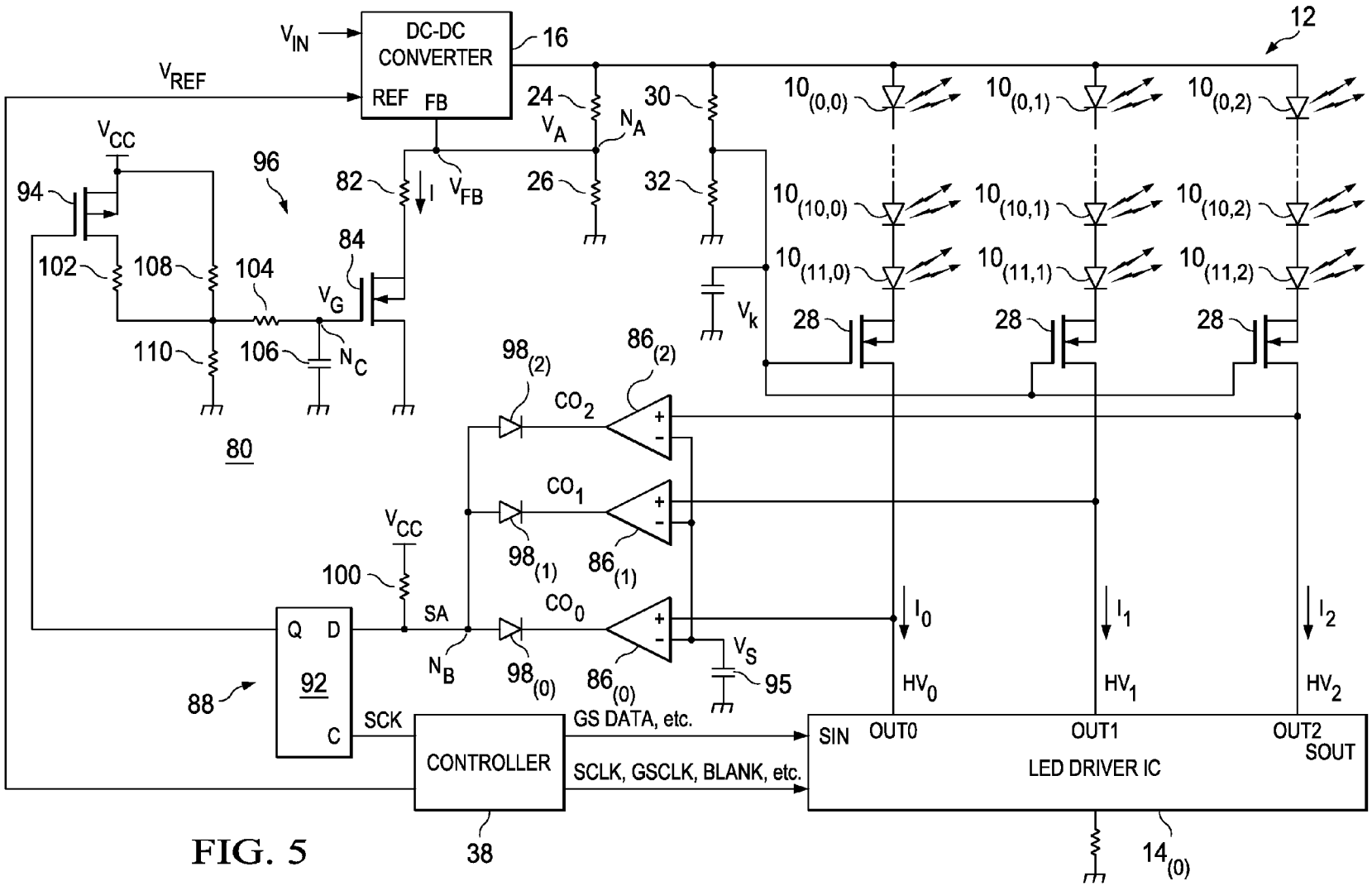
FIG. 5 is a circuit diagram illustrating the constitution of a circuit when an LED array in an LED device of the embodiment has a configuration in which n=12 and m=3.

In the following, an explanation will be given regarding the operation of the LED device in this embodiment while referring to FIGS. 6-10. Here, in order to facilitate explanation, assume that n=12 and m=3 in LED array 12 as shown in FIG. 5. Also, as shown in FIG. 5, in second feedback circuit 80, resistors 108, 110 may be set for providing a constant bias voltage to the gate terminal or node $N_B$ of NMOS transistor 84. In this constitution, NMOS transistor 84 can always remain ON, and bias current (i) can be adjusted.

Figure 6:
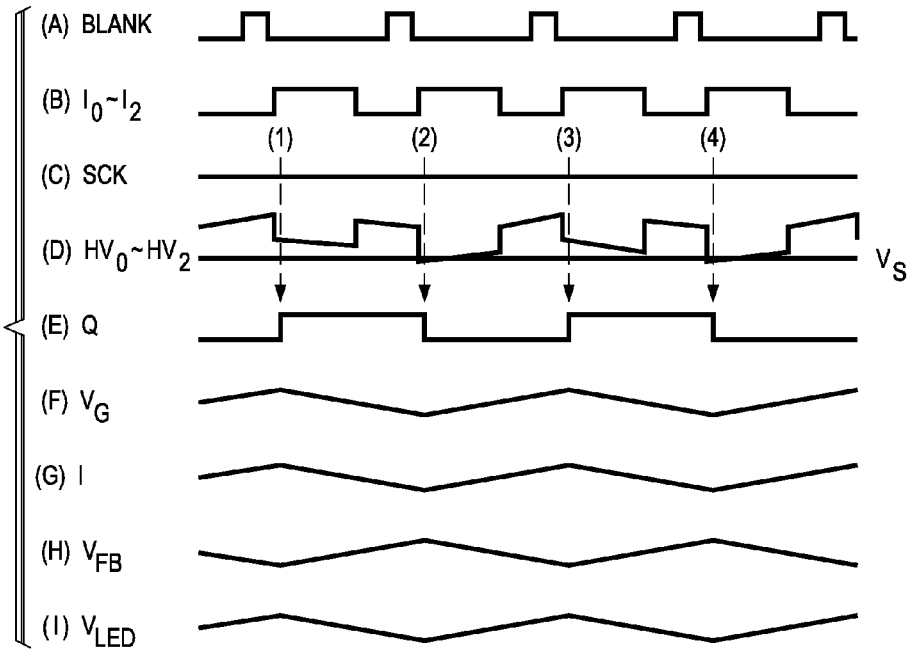
FIG. 6 is a waveform diagram illustrating the waveforms of various portions for illustrating the operation under certain condition of the LED device (FIG. 5) in the embodiment.

FIG. 6 shows an example of waveforms at various portions when the aforementioned LED device is in steady-state operation. FIG. 6(A) shows horizontal blanking signal BLANK given at a prescribed cycle (e.g., 120 Hz) to LED drivers IC 14(*x*) from controller 38.

FIG. 6(B) shows LED driving currents $I_0$, $I_1$, $I_2$ of all the channels of LED array 12. Here, under PWM control, all said LED driving currents $I_0$, $I_1$, $I_2$ are controlled to have the same pulse width.

FIG. 6(C) shows sampling clock SCK given by controller 38 to latch circuit 92 of second feedback circuit 80. As shown in the figure, the timing of sampling clock SCK is set immediately after the start of the variable pulse times of LED driving currents $I_0$, $I_1$, $I_2$ under PWM control.

FIG. 6(D) shows headroom voltages $HV_0$, $HV_1$, $HV_2$ of all the channels. Here, it is assumed that all headroom voltages $HV_0$, $HV_1$, $HV_2$ vary with the same waveform.

FIG. 6(E) shows output signal (Q) of latch circuit 92. FIG. 6(F) shows control voltage $V_G$ at node $N_C$ of second feedback circuit 80. FIG. 6(G) shows bias current (i) flowing in NMOS transistor 84 of second feedback circuit 80. FIG. 6(H) shows feedback voltage $V_{FB}$ input to feedback voltage input terminal FB of DC-DC converter 16. FIG. 6(I) shows LED driving voltage $V_{LED}$ output from DC-DC converter 16.

As shown in FIG. 6, at the timing of sampling clock SCK (1), all headroom voltages $HV_0$, $HV_1$, $HV_2$ are higher than reference voltage $V_S$. As a result, in second feedback circuit 80, output signal (Q) of latch circuit 92 changes from the previous L-level to H-level, control voltage $V_G$ changes from the previous linear rising trend to a linear falling trend, and bias current (i) changes from the previous linear rise to a linear decrease. As a result, in DC-DC converter 16, feedback voltage $V_{FB}$ changes from the previous linear decrease to a linear increase, and the output voltage, that is, LED driving voltage $V_{LED}$, changes from the previous linear rise to a linear decrease. As LED driving voltage $V_{LED}$ linearly decreases, during the period when LED driving currents $I_0$, $I_1$, $I_2$ flow in each cycle under PWM control, headroom voltages $HV_0$, $HV_1$, $HV_2$ linearly decrease, and during the period when LED driving currents $I_0$, $I_1$, $I_2$ do not flow, headroom voltages $HV_0$, $HV_1$, $HV_2$ still linearly decrease.

At the timing of the next sampling clock SCK(2), all said headroom voltages $HV_0$, $HV_1$, $HV_2$ become lower than reference voltage $V_S$. As a result, in second feedback circuit 80, output signal (Q) of latch circuit 92 is changed from the previous H-level to L-level; control voltage $V_G$ changes from the previous linear decrease to a linear increase, and bias current (i) changes from the previous linear decrease to linear increase. As a result, in DC-DC converter 16, feedback voltage $V_{FB}$ changes from the previous linear increase to a linear decrease, while the output voltage, that is, LED driving voltage $V_{LED}$, changes from the previous linear decrease to a linear increase. As LED driving voltage $V_{LED}$ linearly rises, during the period when LED driving currents $I_0$, $I_1$, $I_2$ flow in each cycle under PWM control, headroom voltages $HV_0$, $HV_1$, $HV_2$ rise, and even during the period when LED driving currents $I_0$, $I_1$, $I_2$ do not flow, headroom voltages $HV_0$, $HV_1$, $HV_2$ still linearly rise.

Then, as shown in FIG. 6, the same operation as aforementioned is repeated. In this way, in the LED device in this embodiment, second feedback circuit 80 works on DC-DC converter 16 to dynamically variably control LED driving voltage $V_{LED}$ so that headroom voltages $HV_0$, $HV_1$, $HV_2$ are kept near reference voltage $V_S$, either below or over reference voltage $V_S$.

Figure 7:
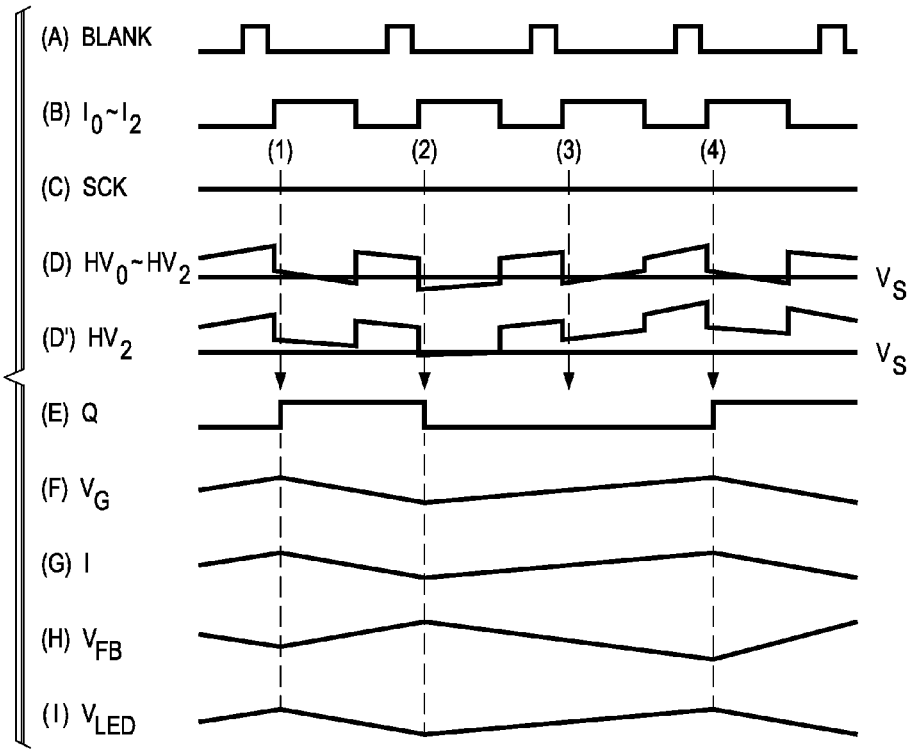
FIG. 7 is a waveform diagram illustrating the waveforms of various portions for illustrating the operation under another condition of the LED device (FIG. 5) in the embodiment.

In the example shown in FIG. 6, it is assumed that headroom voltages $HV_0$, $HV_1$, $HV_2$ all vary with the same waveform when LED driving currents $I_0$, $I_1$, $I_2$ of all the channels are controlled to have the same pulse width under PWM control. However, said headroom voltages $HV_0$, $HV_1$, $HV_2$ may also have different waveforms. FIG. 7 shows the waveforms of the various portions when the waveforms of headroom voltages $HV_0$, $HV_1$ are the same, while the waveform of headroom voltage $HV_2$ is different.

In the case of the example shown in FIG. 7, the operation is similar to that of the example shown in FIG. 6 until just prior to third sampling clock SCK(3). At the timing of said sampling clock SCK(3), headroom voltage $HV_2$ is higher than reference voltage $V_S$, yet headroom voltages $HV_0$, $HV_1$ are lower than reference voltage $V_S$. Consequently, in second feedback circuit 80, output signal (Q) of latch circuit 92 stays at the previous L-level. As a result, control voltage $V_G$ keeps rising linearly, and bias current (i) also keeps rising linearly. As a result, in DC-DC converter 16, feedback voltage $V_{FB}$ keeps falling linearly, while output driving voltage $V_{LED}$ keeps rising linearly.

However, at the timing of fourth sampling clock SCK(4), all headroom voltages $HV_0$, $HV_1$, $HV_2$ are higher than reference voltage $V_S$. As a result, in second feedback circuit (80), output signal (Q) of latch circuit (92) changes from the previous L-level to H-level, control voltage $V_G$ changes from the previous linear rising to a linear falling, and bias current (i) also changes from the previous linear rising to a linear falling. As a result, in DC-DC converter (16), feedback voltage $V_{FB}$ changes from the previous liner falling to a linear rising, and output driving voltage $V_{LED}$ changes from the previous linear rising to a linear falling.

Also in this case, while headroom voltages $HV_0$, $HV_1$ and headroom voltage $HV_2$ have different periods, second feedback circuit (80) works on DC-DC converter (16), and LED driving voltage $V_{LED}$ is under dynamic variable control so that said headroom voltages are kept near reference voltage $V_S$, either below reference voltage $V_S$ or over it.

While not shown in the figure, when headroom voltages $HV_0$, $HV_1$, $HV_2$ all have different waveforms, even if LED driving currents $I_0$, $I_1$, $I_2$ have different pulse widths, output driving voltage $V_{LED}$ of DC-DC converter (16) is under dynamic variable control via second feedback circuit (80) so that while headroom voltages $HV_0$, $HV_1$, $HV_2$ have periods that partially or completely differ from one another, they are kept near reference voltage $V_S$, either under or over reference voltage $V_S$.

In the following, an explanation will be given regarding the effects of the present embodiment with respect to the local dimming function. FIG. 8 shows the pattern in an experimental example in which the duty of the PWM control in a device with the constitution shown in FIG. 5 is switched alternately between 5% and 95% every prescribed period (e.g., 500 sec) so that the luminance of the three blocks $B_1$, $B_2$, $B_3$ of LED array (12) varies in the same way. FIG. 9 shows the waveforms of the headroom voltages $HV_0$, $HV_1$, $HV_2$ and LED driving voltage $V_{LED}$ obtained in this experimental example.

As shown in FIG. 9, in the LED device of this embodiment, LED driving voltage $V_{LED}$ alternately takes two step values, that is, about 41.0 V in the cycle when the duty is 5% and about 40.0 V in the cycle when the duty is 95%. As a result, said headroom voltages $HV_0$, $HV_1$, $HV_2$ are kept close to about 1.5 V throughout the cycles. Also, when LED driving currents $I_0$, $I_1$, $I_2$ are set at 100 mA, the total power consumption generated in LED array (12), LED driver ICs 14(1), 14(2), 14(3) and DC-DC converter (16) is 6719 mW when the ambient temperature is 25° C., and it is 6499 mW when the ambient temperature is 60° C.

FIG. 10 shows the waveforms of headroom voltages $HV_0$, $HV_1$, $HV_2$ and LED driving voltage $V_{LED}$ obtained in the experiment with the same pattern as aforementioned, while second feedback circuit (80) is omitted in the constitution of the device shown in FIG. 5. In this case, said LED driving voltage $V_{LED}$ is about 41.1 V in the cycle when the duty is 5%, and it is about 41.2 V in the cycle when the duty is 95%. There is only a very small change. On the other hand, there is a significant variation in headroom voltages $HV_0$, $HV_1$, $HV_2$. They are about 1.7 V in the cycle when the duty is 5%, and about 2.6 V in the cycle when the duty is 95%. In this comparative example, when LED driving currents $I_0$, $I_1$, $I_2$ are 100 mA, the total power consumption generated in LED array (12), LED driver ICs 14(1), 14(2), 14(3) and DC-DC converter (16) is 6863 mW when the ambient temperature is 25° C., and 6894 mW when the ambient temperature is 60° C.

In this way, experiments have indicated that the LED device in the present embodiment is improved with respect to the stability of the headroom voltage and reduction in the power consumption with respect to the local dimming function.

In the above, embodiments of the present invention have been explained. However, the present invention is not limited to the aforementioned embodiments, and various modifications can be made as long as the technical gist is observed.

For example, in said embodiments, said headroom voltage monitoring circuits (38, 80) monitor headroom voltages $HV_0$-$HV_{m-1}$ of all the channels. However, one may also adopt a scheme in which only a portion of the headroom voltages is monitored. Especially, when the dispersion in characteristics of LED (10) that forms LED array (12) is small, one may adopt a scheme in which only the headroom voltages of one or several selected typical channels are fed back via second feedback circuit (80) to DC-DC converter (16).

In LED driver ICs 14(0)-14(N−1), although not shown in the figures, each LED open detector 76(0)-76(m−1) may be composed of a comparator, a logic circuit and a latch circuit. In this case, the voltage of current terminal $OUT_y$ of each channel is input to one input terminal of each comparator, while prescribed reference voltage $V_{OP}$ is input from a dedicated reference voltage generator to the other input terminal. Consequently, reference voltage $V_S$ for monitoring the headroom voltage and reference voltage $V_{OP}$ for detecting the LED open state are switched in a time division way, so that the same comparator, logic circuit and latch circuit can be shared for first feedback circuit (80) and LED open detectors 76(0)-76(m−1).

The other features of the constitution in each of LED driver ICs 14(*x*), especially the constitution of constant current driving circuits 60(*y*) and PWM controllers 66(*y*) can be modified to various forms. Also, DC-DC converter (16) is not limited to a chopper type voltage boosting scheme. Other schemes, such as a transformer insulating scheme, etc., may be used as well.

The LED device of the present invention is not limited to backlighting, and it may also be used in illumination, display, and other LED applications.

Although the present invention has been described in detail, it should be understood that various changes, substitutions and alterations can be made hereto without departing from the spirit and scope of the invention as defined by the appended claims.

The invention claimed is:

1. An LED driver for driving one or plural LEDs (light emitting diodes) connected in series with each other electrically to emit light, comprising:

a DC power source that outputs a DC LED driving voltage;

a constant current driving circuit connected in series with said LED with respect to said DC power source for providing a constant LED driving current in said LED; and a headroom voltage monitoring circuit for said DC power source to perform dynamic variable control of the voltage level of said LED driving voltage so that the headroom voltage obtained at the current terminal of said constant current driving circuit is kept within a predetermined range of a first reference voltage; wherein said DC power source comprises:

a switching power source part, which has a first switching element that can be turned ON/OFF at a high frequency, and which switches said first switching element ON/OFF and converts said input voltage to said LED driving voltage;

a switching control part, which controls the ON/OFF operation of said first switching element in said switching power source part; and a first feedback circuit that feeds back said LED driving voltage to said switching control part, wherein said headroom voltage monitoring circuit has a second feedback circuit that feeds back said headroom voltage to said switching control part of said DC power source.

2. The LED driver described in claim 1, wherein said switching control part has a reference voltage input terminal and a feedback voltage input terminal, and controls the ON/OFF operation of said first switching element so that the voltage input to said feedback voltage input terminal is equal to a second reference voltage input to said reference voltage input terminal;

said first feedback circuit has a first resistor and a second resistor connected between the output terminal of said switching power source part and the terminal of the reference potential, the node between said first resistor and said second resistor being connected to said feedback voltage input terminal of said switching control part; and said second feedback circuit comprises:

a first transistor connected between said feedback voltage input terminal of said switching control part and said terminal of the reference potential;

a comparator that compares said headroom voltage to said first reference voltage, and outputs a comparison result signal indicating the magnitude relationship between said two voltages; and a feedback controller that controls said first transistor corresponding to said comparison result signal output from said comparator.

3. The LED driver described in claim 2, wherein a third resistor is connected in series with said first transistor between said feedback voltage input terminal of said switching control part and said terminal of the reference potential.

4. The LED driver described in claim 3, wherein said feedback controller comprises:

a latch circuit that latches said comparison result signal output from said comparator every prescribed cycle at a prescribed timing; and wherein said comparison result signal latched with said latch circuit is input as a control signal; when said comparison result signal indicates that said headroom voltage is higher than said first reference voltage, a second transistor is turned ON, so that said first transistor is turned ON or the current flowing in said first transistor is increased; and, when said comparison result signal indicates that said headroom voltage is lower than said first reference voltage, the second transistor is turned OFF, so that said first transistor is turned OFF or the current flowing in said first transistor is decreased.

5. The LED driver described in claim 2, wherein said feedback controller comprises:

a latch circuit that latches said comparison result signal output from said comparator every prescribed cycle at a prescribed timing; and wherein said comparison result signal latched with said latch circuit is input as a control signal; when said comparison result signal indicates that said headroom voltage is higher than said first reference voltage, a second transistor is turned ON, so that said first transistor is turned ON or the current flowing in said first transistor is increased; and, when said comparison result signal indicates that said headroom voltage is lower than said first reference voltage, the second transistor is turned OFF, so that said first transistor is turned OFF or the current flowing in said first transistor is decreased.

6. The LED driver described in claim 5, wherein said feedback controller has a time constant circuit connected between the output terminal of said second transistor and the control terminal of said first transistor.

7. The LED driver described in any of claim 2 further comprising a bias circuit that provides a predetermined bias voltage to the control terminal of said first transistor.

8. The LED driver described in claim 7, wherein said constant current driving circuit comprises:

a constant current source for maintaining said LED driving current constant, a second switching element that is connected in series with said constant current source and can be turned ON/OFF at a high frequency;

and an LED luminance controller that turns said second switching element ON/OFF at a constant periodicity in a pulse width modulation system.

9. An LED driver comprising:

a DC power source that outputs a DC LED driving current;

an LED array having m LED serial circuits (m is an integer of 2 or greater), each having n LEDs (n is an integer of 2 or greater) electrically connected in series, electrically connected in parallel with respect to the output terminal of said DC power source;

m constant current driving circuits for providing a constant LED driving current in said LEDs and connected in series with said m LED serial circuits with respect to said DC power source; and a headroom voltage monitoring circuit for said DC power source dynamically variably controlling the voltage level of said LED driving voltage so that at least one of the headroom voltages obtained at the current terminals of said m constant current driving circuits is kept within a predetermined range of a first reference voltage; wherein said DC power source comprises:

a switching power source part that has a first switching element, which can be turned ON/OFF at a high frequency, and works to turn said first switching element ON/OFF to convert the DC input voltage to said LED driving voltage;

a switching control part that controls the ON/OFF operation of said first switching element in said switching power source part; and a first feedback circuit that feeds back said LED driving voltage to said switching control part wherein said headroom voltage monitoring circuit has a second feedback circuit that feeds back at least one of said headroom voltages to said switching control part of said DC power source.

10. The LED driver described in claim 9, wherein said switching control part has a reference voltage input terminal and a feedback voltage input terminal, and controls the ON/OFF operation of said first switching element so that the voltage input to said feedback voltage input terminal is equal to a second reference voltage input to said reference voltage input terminal;

said first feedback circuit has a first resistor and a second resistor connected between the output terminal of said switching power source part and the terminal of the reference potential, and the node between said first resistor and said second resistor is connected to said feedback voltage input terminal of said switching control part;

said second feedback circuit comprises:

a first transistor connected in series between said feedback voltage input terminal of said switching control part and the terminal of the reference potential;

at least one comparator that compare at least one of said headroom voltages to said first reference voltage, and output a 2-value level comparison result signal indicating the magnitude relationship between said two voltages; and a feedback control circuit that controls said first transistor to comply with one or several said comparison result signals output from one or several said comparators, respectively.

11. The LED driver described in claim 10, further comprising a third resistor connected in series with said first transistor between said feedback voltage input terminal of said switching control part and said terminal of the reference potential.

12. The LED driver described in claim 11 wherein said feedback controller comprises:

a latch circuit that latches the 2-value level judgment signal every prescribed cycle at a prescribed timing, which indicates the AND or OR of one or several said comparison result signals output from one or several said comparators, respectively, and wherein said judgment signal latched with said latch circuit is input as a control signal; when said judgment signal indicates that all of said headroom voltages input to all of said comparators are higher than said first reference voltage, a second transistor is turned ON, said first transistor is turned ON or the current flowing in said first transistor is increased; and when said judgment signal indicates that at least one of said headroom voltages is lower than said first reference voltage, the second transistor is turned OFF, said first transistor is turned OFF, or the current flowing in said first transistor is decreased.

13. The LED driver described in claim 10 wherein said feedback controller comprises:

a latch circuit that latches the 2-value level judgment signal every prescribed cycle at a prescribed timing, which indicates the AND or OR of one or several said comparison result signals output from one or several said comparators, respectively, and wherein said judgment signal latched with said latch circuit is input as a control signal; when said judgment signal indicates that all of said headroom voltages input to all of said comparators are higher than said first reference voltage, a second transistor is turned ON, said first transistor is turned ON or the current flowing in said first transistor is increased; and when said judgment signal indicates that at least one of said headroom voltages is lower than said first reference voltage, the second transistor is turned OFF, said first transistor is turned OFF, or the current flowing in said first transistor is decreased.

14. The LED driver described in claim 13, wherein said feedback controller has a damping time constant circuit connected between the output terminal of said second transistor and the control terminal of said first transistor.

15. The LED driver described in claim 10 further comprising a bias circuit that provides a prescribed bias voltage to the control terminal of said first transistor.

16. The LED driver described in claim 15, wherein each said constant current driving circuit comprises:

a constant current source for keeping said LED driving current constant;

a second switching element that is connected in series with said constant current source and can be turned ON/OFF at a high frequency; and an LED luminance controller that turns ON/OFF said second switching element every prescribed cycle with a pulse width modulation system.

17. The LED driver described in claim 9 wherein one face light source consists of m blocks;

m said LED serial circuits and m said constant current driving circuits are allotted to said m blocks, respectively;

in each said block, n said LEDs that form said LED serial circuit are arranged two-dimensionally with a constant density distribution.

18. The LED driver described in claim 17, wherein in each block of said m blocks, the duty is individually controlled with said pulse width modulation system.

* * * * *